US006536342B2

(12) United States Patent
Rodgers

(10) Patent No.: US 6,536,342 B2
(45) Date of Patent: Mar. 25, 2003

(54) LOW RESILIENCE, HIGH INK RELEASING PRINTING SURFACE

(75) Inventor: Richard Rodgers, Hudson, MA (US)

(73) Assignee: MacDermid Graphic Arts, Inc., Atlanta, GA (US)

( * ) Notice: Subject to any disclaimer, the term of this patent is extended or adjusted under 35 U.S.C. 154(b) by 0 days.

(21) Appl. No.: 09/894,286

(22) Filed: Jun. 28, 2001

(65) Prior Publication Data

US 2003/0010238 A1 Jan. 16, 2003

(51) Int. Cl.[7] ..... B41N 10/04

(52) U.S. Cl. ..... 101/379; 101/368; 101/395; 101/401; 428/909

(58) Field of Search ..... 101/453, 463.1, 101/368, 375, 376, 379, 395, 401.1, 401; 428/909

(56) References Cited

U.S. PATENT DOCUMENTS 3,861,917 A * 1/1975 Magnotta et al. ..... 101/129
3,881,045 A * 4/1975 Strunk ..... 101/401.1
4,238,560 A * 12/1980 Nakamura et al. ..... 101/454
4,446,220 A * 5/1984 Proskow ..... 264/219
5,347,927 A 9/1994 Berna et al. ..... 101/401.1
5,486,402 A 1/1996 Flint et al. ..... 428/141
5,974,974 A 11/1999 Agnew et al. ..... 101/401.1

FOREIGN PATENT DOCUMENTS

WO WO 9618932 A1 * 6/1996 ..... B41M/1/00

* cited by examiner

*Primary Examiner*—Daniel J. Colilla
(74) *Attorney, Agent, or Firm*—Carmody & Torrance LLP

(57) ABSTRACT

Novel printing surfaces for off-set printing blankets are provided having a resilience of less than about 40% and an average surface roughness of less than about 0.5 microns. Such low-resilience printing surfaces have been found to transfer up to greater than 90% of the ink applied thereto and can be used to transfer ink on a wide variety of substrates.

10 Claims, 4 Drawing Sheets

LOW RESILIENCE, HIGH INK RELEASING PRINTING SURFACE

FIELD OF INVENTION

The present invention relates to printing blankets of the type used in offset lithography, and more particularly to the use of a printing blankets having a low-resilience printing surface.

BACKGROUND OF THE INVENTION

An offset printing blanket is used to transfer ink and fountain solution (primarily water) to paper or other substrates from a printing plate on a printing press. It can also serve a similar function in transferring other coatings including, for example, varnishes. As used herein, the term "ink" refers to any printing fluids or coating. Also, the term "printing blanket" as used herein refers to any of the forms that may achieve the same basic function of printing. Printing blankets are typically wrapped around a cylinder and the paper is either sheet feed or fed on a web between the rollers.

The role of a printing blanket is to transfer dots of ink and water films from a printing plate in an offset press to a substrate (typically but not exclusively paper). The surface of the blanket must have a natural affinity (i.e., adhesion) to ink in order to pick up ink from a printing plate. When that ink is then pressed into contact with the substrate, some of the ink comes off of the blanket and wets the surface of the substrate and printing is achieved. Not all of the ink on the blanket is transferred to the substrate due to the natural tendency for the ink closest to the blanket to adhere to the blanket surface.

In this connection, only 30% to 40% of the ink on a blanket will typically transfer to the substrate in printing. That means that some ink remains on the blanket and is over-coated with additional ink on subsequent rotations of the printing press. The ink that stays on the blanket will increase in tack level (i.e., adhesiveness) the longer it stays on the blanket, further limiting the amount of ink that may be transferred to the substrate. This phenomenon typically limits print quality since ink that stays on the blanket is also continuously exposed to water. The water emulsifies the ink in time and may degrade the color brightness of the ink, and also allow it to be printed in areas that were not intended to contain printed images (the non-image area). Also, on each revolution of the printing press the ink left behind on the blanket is exposed to compression and shear forces when pressed against the substrate or against the printing plate. These contact areas are known as "nips." The longer the ink stays on the surface, therefore, the more opportunity there is to gradually spread or distort the ink, widening the printed dot, and creating a slurring of the print and dot gain.

Offset printing blankets typically have a multi-layer construction that comprises layers of fabric, foam and reinforcing rubber layer(s) (collectively known as the blanket carcass and stabilizing layer) and the topmost layer called the surface layer. Good quality printing is generally dependent on the overall construction or design of the printing blanket as well as the materials and topographical characteristics of the layer used for the printing surface.

The surface layer plays a critical role in transferring the print impression from the lithographic printing plate to the printed substrate and is consequently required to have a good balance of surface wettability and affinity for the oil-based ink and water-based fountain solution used in the lithographic printing. The surface layer must be able to withstand repeated contact with the ink and fountain solutions and must also have good compressibility and resiliency. That is, the blanket must be able to be compressed between the two cylinders, but have sufficient resiliency to return to its original thickness quickly enough to be ready for the next impression. An important property of the blanket is that by its nature and structure it must permit the development of even, uniform printing pressures in order to achieve a quality finished product. Furthermore, the blanket must have a firm, non-extendible base in order that it may be held under tension on the offset cylinder without stretching or becoming distorted in any way.

There are many types of printing blanket designs available including sheets cut from rolls that are then mounted onto a printing press via adhesives or by various clamping mechanisms including but not limited to the use of blanket bars, endless or gapless tubular constructions known generally as "blanket sleeves," metal backed blankets, etc. All of these designs and uses of blankets must be capable of transferring ink generally printed as small dots with a minimum of blurring of the edges of the dot in order to produce a "sharp" image. Any surface texture to the printing blanket tends to allow the ink to spread on the surface to some degree and reduce the sharp visual appearance of the printed dots or the otherwise straight edges to printed or coated areas. The ideal limit to achieving the sharpest printing would be to use a completely smooth and non-textured surface. However, the inks are required to have a level of tackiness that provides some bonding to the plate, blanket, and substrate to be printed on. This tackiness makes release from an extremely smooth surface more difficult. Release of the ink from the blanket surface is enhanced by increasing the texture (i.e., roughness) of the surface. Increasing surface roughness, however, limits the printing sharpness that can be achieved. Additionally, it is well known in the art that a very smooth surface will create a mottled appearance to "printed solids," that is printed areas that are meant to have a complete covering of ink. Smooth surfaces generally release ink poorly and unevenly on a microscopic scale. Thus, a textured surface will typically produce a more visually appealing smoother looking printed solid by improving on ink release.

The most common technique in the art that attempts to maximize print quality overall by balancing the desire to produce sharp printed dots and visually appealing solids is by the use of a buffed surface. As used herein, the term "buffed" refers to the surface of a blanket that is finely ground to achieve a micro-textured surface topography that releases ink well but is meant to limit the distortion of the sharp dot edges. Alternative approaches include molding the surface against a casting medium (commonly a release paper) or manufacturing the surface with small holes or ink wells. Both of these techniques are limiting in the quality of the solids printed or in the sharpness of the dot printed. The average roughness (Ra value) of these buffed surfaces is, however, typically 0.5 microns or greater.

It is generally accepted in the art that the surface layer of a printing blanket must be made of a highly resilient material that is ink (and usually fountain solution) receptive. Typically these surfaces are made from a variety of rubber or rubber-like polymeric materials that are formulated along with other features for their ink and water receptivity and resilience. High resilience is viewed as a requirement due to the very small amount of time (micro-seconds) available in a printing nip between blanket and plate or blanket and substrate being printed. It is believed that high resilience provides the physical responsiveness required to allow the blanket surface to quickly conform to the roughness of the printed substrate in particular and to transfer good quality ink dots and solids. Additionally, it is believed that, a low resilience printing layer would require a highly textured surface which then would adversely effect print sharpness. The reasoning is that a highly textured surface would carry a thicker ink film and so compensate for the loss of contact time in the printing nip due to the poor ability of the low resilience printing layer to stay in intimate contact with the printing substrate.

High resiliency of the blanket's printing layer, however, has become a problem with increased demand for higher speed printing. For example, press speeds in offset printing have risen from approximately 1200 ft/min to 3000 ft/min in the last 15 years. The desire for increases in speed has come from the need for printers to have increased productivity to remain competitive. As printing press speeds have increased, it has become more difficult to achieve high print quality. Higher printing speeds mean that the press cylinders are spinning faster, thus, the ink used must have a higher adhesion or "tack" level to stick to the blanket, plate, and inking cylinders, otherwise the ink is sprayed off of the cylinders and can not print well. The problem is that, as described above, as ink tack levels are increased, it becomes increasingly harder to then transfer the ink from the blanket onto the paper or other printing substrate. Thus, the need exists then for improved release at higher printing speeds.

A highly resilient printing surface on a blanket will more easily elongate outward as the ink is pulled off of the blanket and, therefore, delay putting tension on the ink that is being transferred to the printing substrate. The result is to hinder release of the ink. A low resilient surface, however, will not move quickly in being pulled upward from the blanket surface and, so, will release ink faster. As press speeds are increased a highly resilient surface will continue to respond quickly to the forces the ink is putting on the surface and will make ink release more difficult as ink tack levels are increased for the higher press speeds. It is speculated that a low resilient surface will be unable to keep up with the faster motions the ink is experiencing at higher speeds and so will put added force on the ink, forcing it to release easily. Thus, it is believed that, ultimately, a highly resilient blanket surface will not act to improve ink release at higher speeds and a low resilient surface will. This conclusion, however, is counter to the accepted art that has driven towards increased resilience in blanket surfaces and other components for higher speed applications. The traditional belief is that higher resilience is needed for the blanket to respond to the faster dynamics of high speed printing. In actuality, the result of the use of highly resilient blanket materials leads to a very limited operating window on press as to acceptable ink tack levels and has lead to a reduction in print quality on high speed printing.

On slower speed, sheet fed presses, for example, the benefit of low resilient surfaces are also seen since the printing nip is still dynamic and an improvement in release is still observable. In particular, when the printed sheet is peeled off of the printing blanket, improved release of the ink allows for a reduction in the contact time between blanket, ink, and paper and so, reduces distortions in the printed dots. That improvement in release has allowed heretofore impractical degrees of surface smoothness to be used that would otherwise have provided very poor ink release, giving poor print quality. A highly smooth surface provides very sharp, smooth printed dots that visibly increase the image resolution that is possible for offset printing.

High resiliency of the blanket's printing layer is also an issue with respect to the substrate to which the ink is being transferred. For substrates having a rough surface such as, for example, rough paper stocks, good ink transfer and release is fairly easy to achieve since the rough surface helps to break the ink dots that are being printed and, so, release the ink. Glossy paper, however, is very smooth and makes the release more difficult. The desire in the art is to use a very smooth blanket surface to print on a very smooth paper to achieve the highest print quality. Release of the ink then becomes very difficult with traditional, resilient blanket surfaces and the ultimate print quality is limited. Having a low resilient surface allows the resolution possible in offset printing to no longer be limited by the roughness of the surface of the blanket, only by the choice of paper used.

Thus, there is a need in the art for a printing blanket having a surface that has the ability to print high quality images on a variety substrates having different textures and at high speeds.

SUMMARY OF INVENTION

The inventor has found that, independent of the materials used to form the printing surface of the present invention, a high quality image that can be printed on a variety of substrates having different textures at high speeds can be achieved when the printing surface of the printing blanket exhibits certain physical characteristics. Surprisingly, it has been found that a smooth, low-resilience surface described herein has been shown to transfer a much higher percentage of ink applied to it. By transferring more ink, the ink has less opportunity to be emulsified with water, resulting in higher print quality. With less ink remaining on the surface of the blanket there is also less distortion of the dots that is possible due to the forces in the printing nips and sharper, higher resolution images can be produced.

Specifically, an offset printing blanket is provided comprising a printing layer and a base, wherein the printing layer has a Shore Resilience of less than about 40% and an average surface roughness of less than about 0.5 microns.

A method for achieving superior ink-transfer onto a substrate according to the present invention is provided comprising the steps of providing an offset printing blanket comprising a printing layer and a base, wherein the printing layer has a Shore Resilience of less than about 40% and an average surface roughness of less than about 0.5 microns. Ink is transferred to said offset printing blanket from an image-bearing printing element. The ink is then transferred from said offset printing blanket onto a substrate, wherein at least about 75% of said ink is transferred from said offset printing blanket to said substrate.

According to another aspect of the present invention, a method is provided for determining the suitability of an off-set printing blanket to transfer ink based upon resilience measurements of the blanket's printing surface. The method comprises providing a printing blanket having an elastomeric printing surface, determining whether the resilience of the printing surface is below about 40%, and utilizing the printing blanket if the resilience of the printing surface is below about 40%.

BRIEF DESCRIPTION OF THE DRAWINGS

These and other more detailed objects of the present invention will be fully disclosed in the following detailed description and descriptions of the drawings in which like numerals represent like elements and in which.

DETAILED DESCRIPTION OF THE INVENTION

Figure 1:
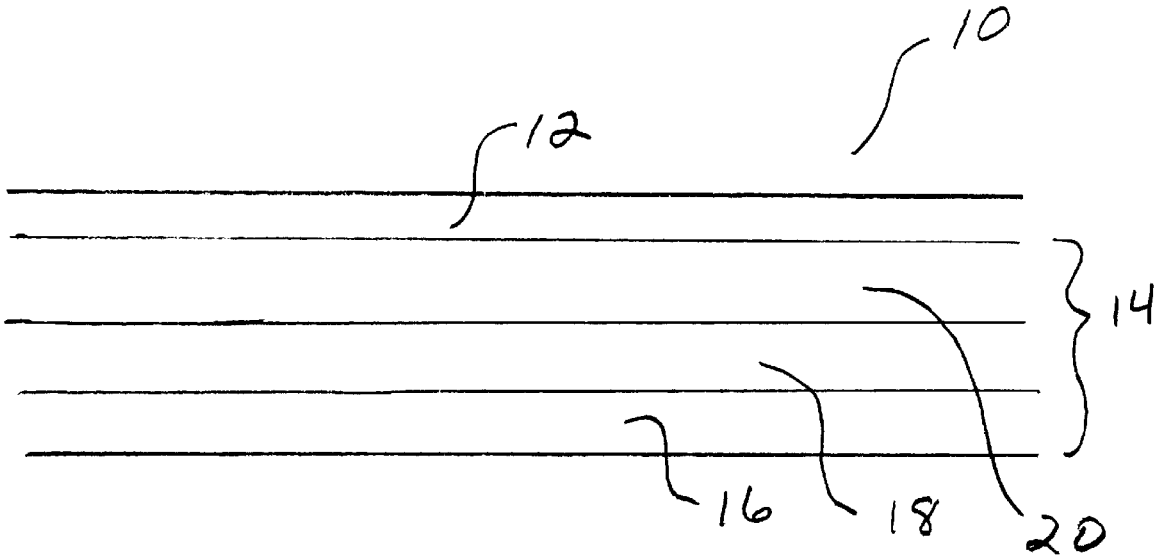
FIG. 1 is a sectional view of a printing blanket according to the present invention.

The printing blanket 10 of the present invention is illustrated in FIG. 1 and comprises a low-resilience printing surface 12 and a base 14. As used herein, the term "base" refers to any layer, or the sum of layers of a printing blanket, excluding low-resilience printing surface 12. Without intending to be limiting, the base exemplified in FIG. 1 comprises at least one woven fabric base ply layer 16, a compressible layer 18, which may be foam, and an intermediate fabric layer woven fabric 20. As is conventional in the art, the layers of the base, as well as the printing surface 12, may be laminated together with an adhesive (not shown), which may be a rubber cement such as a nitrile or neoprene rubber or other suitable adhesive material to form the printing blanket 10. Base 14 may be of any composition suitable for use as a printing blanket base according to the present invention.

Low-resilience printing surface 12 is typically formed from any suitable elastomeric material including both natural rubbers and synthetic resins. For example, low-resilience printing surface 12 according to the present invention can be formed from elastomeric polymers produced by photopolymnerization. Representative elastomeric polymers include polyuretaes, polyetlers, epichlorohydrins and acrylonitriles. Preferred elastomeric photopolymers are the polyurethanes and, more preferably, those commercially available by MacDermid Graphic Arts (Atlanta, Ga.) under the name FLEX LIGHT F240, D250, and D150. Printing blankets according to the present invention having low-resilience printing surface 12 formed from such photopolymer elastomers can be produced, for example, according to the process described in U.S. Pat. No. 5,974,974, which is herein incorporated by reference, or by any other process known in the art.

Alternatively, low-resilience printing surface 12 can be formed by adding fillers to traditional rubber-based elastomeric printing surfaces used for ink transfer and imaging such as, for example, acrylonitrile butadiene rubber, isobutylene isoprene elastomer, polysulfide rubber, ethylene propylenediene terpolymer, natural rubber, neoprenes, nitrile rubbers such as NBRs (nitrile butadiene rubber), styrene butadiene rubber, and a blend of acrylonitrile-butadiene and polysulfide rubber. Typical fillers that can be used are, for example, carbon black, synthetic fibers, glass beads, thermoplastic microspheres, silicas, and any other means known to those skilled in the art to lower the resilience of an elastomer. Carbon black is preferred.

When adding a filler such as carbon black to a traditional rubber-based printing surface, low-resilience printing surface 12 may be formed in a conventional manner such as, for example, by compounding the filler with an unvulcanized rubber compound in a suitable solvent and subsequently knife coating the solution onto a fabric carcass. Typically, the application is made in a plurality of thin coats. After each coat is applied, the solvent is allowed to evaporate so that the resultant rubber layer is substantially solvent free. Typically, heat is then applied to cure the rubber.

Additional ingredients commonly added to rubber compositions used as processing, stabilizing, and strengthening additives may be present in low-resilience printing surface 12 such as known stabilizers, pigments, antioxidants, bonding agents, plasticizers, cross-linking or vulcanizing agents and blowing agents.

The superior ink-transfer performance of the printing surface 12 as described below is independent of the chemical composition of printing surface 12. Rather, the superior ink-transfer properties of the printing surface 12 are attributed to certain physical characteristics, such as the requisite resilience and smoothness as detailed below.

As used herein, "resilience" refers to the ability of a strained body, by virtue of high yield elongation limits and very low energy loss on deformation, to recover its size and form following deformation. Resilience is typically measured with a Shore Resilomenter according to ASTM test method D2632-96, herein incorporated by reference in its entirety. In short, the determination of resilience is accomplished by dropping a plunger of a specific mass and geometry from a predetermined height to the surface of a test specimen and measuring the distance that the plunger rebounds after contact and calculating the ratio of rebound distance to the distance traveled by the mass prior to contacting the test specimen. This ratio is typically expressed as a percent. Preferably, the low-resilient printing surface 12 of the present invention has a Shore Resilience value of less than about 40% and, more preferably less than about 30%, and even more preferably less than about 20%.

A low-resilient surface will release ink more easily. As used herein, "ink transfer" or "ink release" refers to the percentage of ink that once coated on the surface of the blanket will then be transferred to a substrate on printing. Typically, an IGT standard laboratory printability tester is used to measure ink release. In this case a measured amount of ink is put on the surface of the blanket to be tested. The inked surface is then rolled against a piece of mylar and the amount of ink transferred is then measured. After several tests are done it is possible to plot the amount of ink transferred (Y axis) as a function of the amount of ink applied (X axis). The closer the slope of the line comes to 45 degrees the better the ink transfer. That is, a slope of 45 degrees means that all of the ink applied to the surface of the blanket has been transferred to the substrate. In this test mylar is used as the printing substrate. It is used since it will not inherently absorb ink as would a paper, for example. By avoiding the use of an substrate that would absorb ink then the experimental variability in ink transfer that would create is avoided.

The high ink-releasing surface described here has been shown to transfer a much higher percentage of ink applied to it. By transferring more ink then the ink has less opportunity to be emulsified with water, resulting in higher print quality. With less ink left on the surface of the blanket there is also less distortion of the dots that is possible due to the forces in the printing nips and sharper, higher resolution images can be produced.

Surface smoothness is measured with a profilometer, such as, for example, a Surfometer, commercially available from precision Devices, Inc., Milan, Mich. Such profilometers have become a standard means of describing the surface texture of printing blankets. The technique employed takes a fine stylus, similar to a phonograph needle, and drags it across the surface of the test material. The movement of the stylus as it follows the micro-texture of the surface is then recorded. The results can often be displayed graphically providing a view similar to a high-resolution microscopic cross-section of the surface profile. Typically the device will analyze the surface profile and provide several measures of the roughness. The most commonly used measurement is referred to as the "Ra" or average roughness. The Ra is the arithmetic mean of the profile versus its centerline. The higher the value the rougher the surface. Most normally it has been found that a surface roughness of a buffed surface in the range of about 0.5 to about 0.9 microns provides the best balance between of printing properties. Smoother surfaces (Ra less than about 0.5 microns) generally print sharper dots but ink release and good printing of large areas of solids (areas completely covered by ink) both suffer. At higher roughnesses (Ra greater than about 0.9 microns) a greater amount of ink is carried by the blanket due to its deeper texture having an increased surface area and better printing of solids is achieved. However, at these higher surface roughnesses, sharpness is sacrificed.

Printing blanket surfaces can also be produced by casting against a surface to provide a specific texture. The most common approach very well known in the art is to use a release paper. With the use of a release paper smoother textures can be achieved, for example about 0.3 to about 0.4 microns, but as stated ink release and quality of printed solids is notably poorer. In the current invention it was seen that high printing quality with no loss in ink release was able to be achieved even with Ra values of about 0.15 to about 0.2 microns. For reference, this very smooth texture is less rough than that of a very heavily coated paper stock used for high quality printing with an Ra value of about 0.22 microns. Thus, it was seen that the printing blanket was no longer the limiting factor in achieving the theoretically highest possible print sharpness that offset printing could reach.

A method for achieving superior ink-transfer onto a substrate according to the present invention comprises the steps of providing an offset printing blanket comprising a printing layer and a base, wherein the printing layer has a Shore Resilience of less than about 40% and an average surface roughness of less than about 0.5 microns. Ink is transferred to the offset printing blanket from an image-bearing printing element. The ink is then transferred from the offset printing blanket onto a substrate, wherein at least about 75% and, preferably, at least about 90% of the ink is transferred from said offset printing blanket to said substrate.

Also in accordance with the invention, a method is provided for determining the suitability of an off-set printing blanket to transfer ink based upon resilience measurements of the blanket's printing surface. The method comprises providing a printing blanket having an elastomeric printing surface, determining whether the resilience of the printing surface is below about 40%, and, in response to a determination that the resilience of the printing surface is below about 40%, utilizing the printing blanket to transfer ink from the blanket's printing surface to a substrate.

The following non-limiting examples are provided solely for the purpose of illustration and are not to be construed as limiting the invention in any manner.

EXAMPLES

A Composition According to the Present Invention

A low-resilience printing surface according to the present invention can be made by compounding the following ingredients in a rubber mill:

| INGREDIENTS | PARTS |
|---|---|
| NIPOL 1032 (synthetic rubber available from Zeon Chemical Company, Louisville, Kentucky) | 50.0 |
| POLYSULFIDE FA (polysulfide available from HM Royal, Trenton, New Jersey) | 12.3 |
| NEOPHAX A FACTICE (vulcanized vegetable oil available from Harwick Chemical Company, Akron, Ohio) | 7.4 |
| KADOX 911 ZINC OXIDE (available from C.P. Hall Co., Chicago, Illinois) | 4.6 |
| TIPURE R-900 $TiO_2$ (available from E.I. DuPont de Nemours & Co., Wilmington, Delaware) | 6.1 |
| N-550 CARBON BLACK (available from Sid Richardson Carbon Co., Akron, Ohio) | 9.2 |
| TP-90B (plasticizer available from HM Royal, Trenton, New Jersey) | 4.6 |
| STEARIC ACID (available from C.P. Hall Co., Chicago, Illinois) | 0.7 |
| IRGANOX 1520 (antioxidant available from Ciba Specialty Chemicals Additives Division, Tarrytown, New York) | 1.8 |
| RODO #10 (deoderant available from R.T. Vanderbilt Co., Inc., Norwalk, Connecticut) | 0.3 |
| METHYL TUADS (sulfur-containing accellerator available from Elastochem Inc., Chardon, Ohio) | 1.5 |
| ETHYL TUADS (sulfur-containing accellerator available from Elastochem Inc., Chardon, Ohio) | 1.5 |
| Total | 100 |

A solvent such as toluene is added and the low-resilience printing surface layer can be prepared using a solvent cast technique to coat a transfer medium such as a mylar sheet and then permitting the material to dry. In the alternative, the surface layer can be solvent cast directly onto the blanket carcass that has been coated with an adhesive, dried and cured at about 300° F. The thickness of this surface material can be from about 4 mils to about 15 mils thick, preferably about 8 mils to about 12 mils thick, and most preferably about 10 to about 12 mils. When using a transfer sheet, the sheet with the compound side down, is placed onto the carcass and adhesively attached thereto. An appropriate adhesive would be easily determined by one of ordinary skill in the art. In addition to the solvent casting, the composition can be spread to form the surface layer using other spreading techniques as well, including spraying, rolling, painting, brushing, and curtain coating.

In another method of preparing the low-resilience printing surface layer, the composition described above is solventlessly mixed and spread by extruding the molten or softened solid onto the carcass or a transfer medium. This can be accomplished, for example, by mixing the ingredients in a sigma, batch or continuous mixer and then extruding the molten or softened solid through an appropriate extruder die head. The surface layer is attached to the carcass by the same means as described above for the solvent cast method. Of course, the time for curing will vary depending on the thickness of the surface layer and material used.

Performance of the Low-Resilience Printing Surface of the Present Invention

Figure 2:
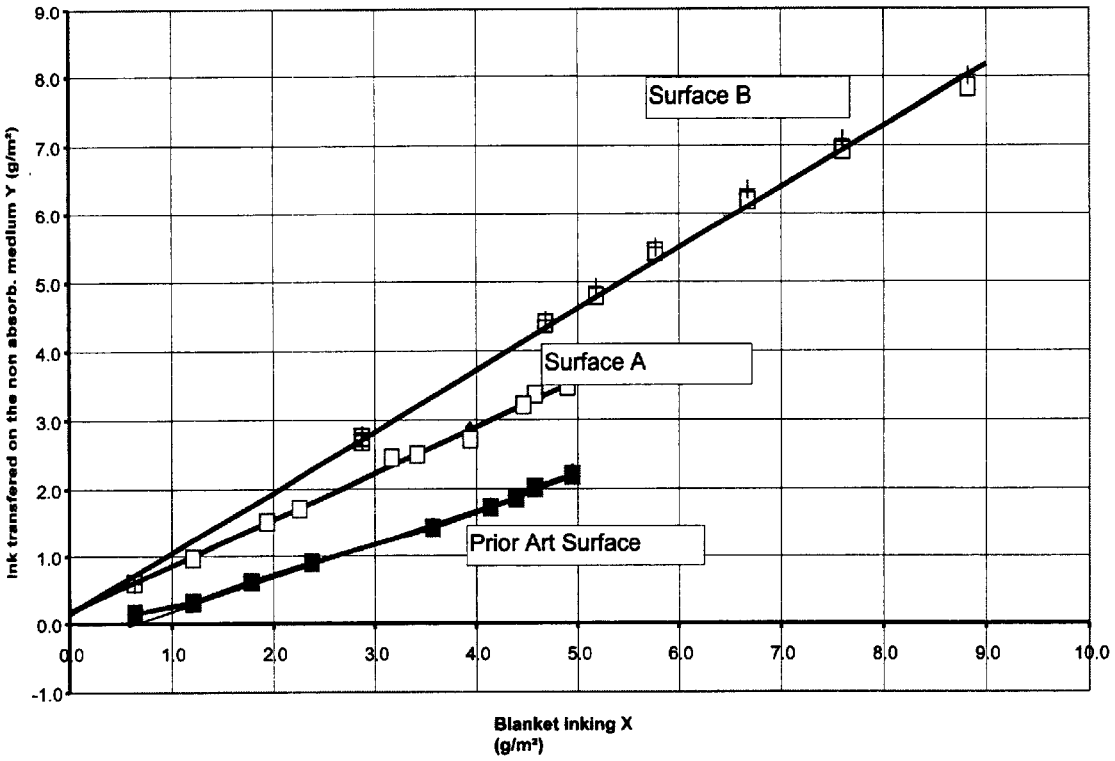
FIG. 2 illustrates the ink transfer of the low-resilience printing surface of the present invention compared with that of a prior art printing blanket.

FIG. 2 illustrates the difference in ink transfer that is observed with the low-resilience printing surface described herein versus a standard, prior art printing blanket. The test was performed with a standard IGT Printability Tester used in the printing industry to evaluate laboratory samples of printing blankets, printed substrates and inks. In this test a measured amount of ink is applied via roller over the surface of the printing blanket. The ink applied to the surface is measured in the grams of ink applied per square meter ($g/m^2$) of blanket surface. Applied amounts ranged from nearly zero to as much as 5 $g/m^2$ for the standard printing surface. For the experimental printing surface ink was increased to a maximum of 9 $g/m^2$ to test for the effect of excessive ink levels. Applied levels of 3 to 4 $g/m^2$ represent the quantity of ink typically used in printing. The applied levels of ink are shown as the "X" or horizontal axis of FIG. 2. The "Y" or vertical axis is a measure of the amount of ink transferred to a plastic film selected for its 15 affinity to ink being similar to paper (the most common substrate used for printing). The film has the advantage of not absorbing into it any of the ink applied to it allowing for a clearer visual indication of how evenly ink is transferred but also avoids variation due to chemical and humidity influences on the paper. Each ink level to be tested requires a separate ink transfer experiment to be performed.

Multiple tests were performed in order to verify both repeatability of the test and to cover the full range of applied ink levels to be tested. Examples of IGT testing of the experimental surfaces versus standard surfaces are illustrated in FIG. 2. The prior art surface was a typical ENDURA rubber printing blanket with a surface roughness of approximately 0.7 to 0.8 microns (commercially available from MacDermid Graphic Arts, Atlanta, Ga.). Resilience of the prior art surface was 56%. Surface A had a resilience of 23% and a surface roughness of Ra=0.2 microns. Surface B had a resilience of 18% and a surface roughness of Ra=0.1 microns. Note that for each of Surface A and B, the slope of the ink transfer curve was close to the ideal 45 degree slope and both start at the origin of the chart (at 0 for X and 0 for Y). The prior art surface was selected for its ability to provide what was considered to be good printing performance with good ink transfer. The particular prior art surface selected was chosen due to its very smooth texture, made with a cast surface, so as to reasonably simulate the texture relative to low-resilience surfaces A and B. The IGT curve of the prior art surface, however, was not only at a lower slope than those for low-resilience surfaces A and B, but also the curve did not start at the origin. In fact, as has been seen to be typical with prior art blanket surfaces, some amount of ink must be first applied to the surface before ink transfer can take place. In this case approximately 0.5 g/m2 was required before ink was transferred. The surface properties require that some amount of ink must be always kept on the prior art surface to allow any ink to be transferred.

As can be seen in FIG. 2, two versions of the low-resilience surface in two separately conducted series of tests consistently showed much higher degree of ink transfer ability over prior surfaces. For example, at 4 $g/m^2$ applied ink level the prior art surface transferred 1.6 $g/m^2$ a transfer percentage of 40%. However, the low-resilience surface A transferred 3.0 $g/m^2$ (75%) and low-resilience surface B transferred 3.6 $g/m^2$ (or 90%) of the ink. These levels of ink transfer were previously unachievable.

The low-resilient printing surfaces according to the present invention have been applied on a typical blanket base with surprisingly successful results in printing on a wide variety of paper substrates such as, for example, coated and uncoated stocks, light weight paper stocks to heavy weight papers and "board stocks"(e.g.; cardboard), and rough highly absorbant stocks such as newsprint as well as on plastic films. Normally it would be expected that a wide range of blanket bases would be required to achieve noticeable improvement in print quality in such a range of market needs. In this case, it was found that such a range of blanket bases was not required. It is to be expected that further improvements in printing performance would be expected from the use of alternative blanket bases but it was not a requirement to see the improved printing performance. The blanket base used in this case was of a design comprising the experimental surface of approximately 12–15 mils thick, adhesive layers, a reinforcing fabric layer, a compressible foam layer, and fabric layers comprising the bottom layers of the blanket. Adhesive layers and additional foam and fabric layers can be included in the basic design.

Figure 3A:
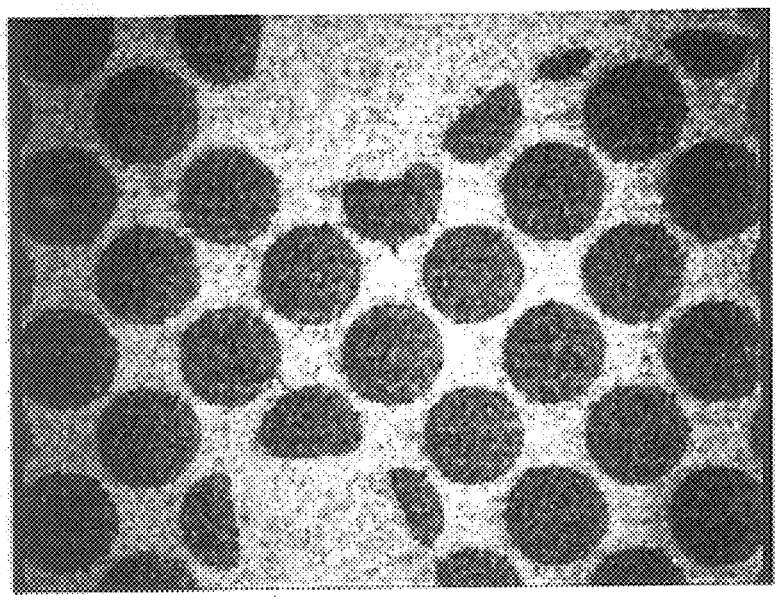
FIG. 3A is a micrograph of an area of an offset printing plate of a 50% screen of dots taken at 200×magnification.
Figure 3B:
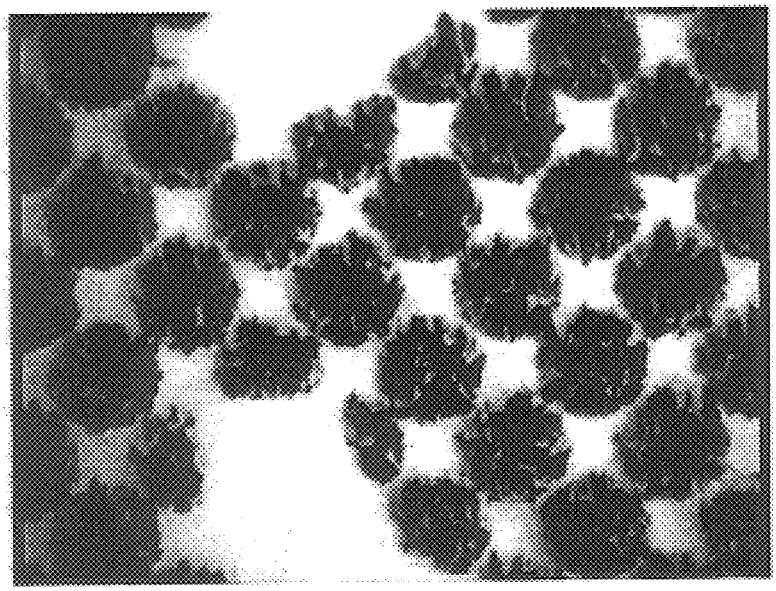
FIG. 3B is a micrograph of the same area of FIG. 2A as printed on a smooth coated paper using a high-quality prior-art printing blanket at 200×magnification.
Figure 3C:
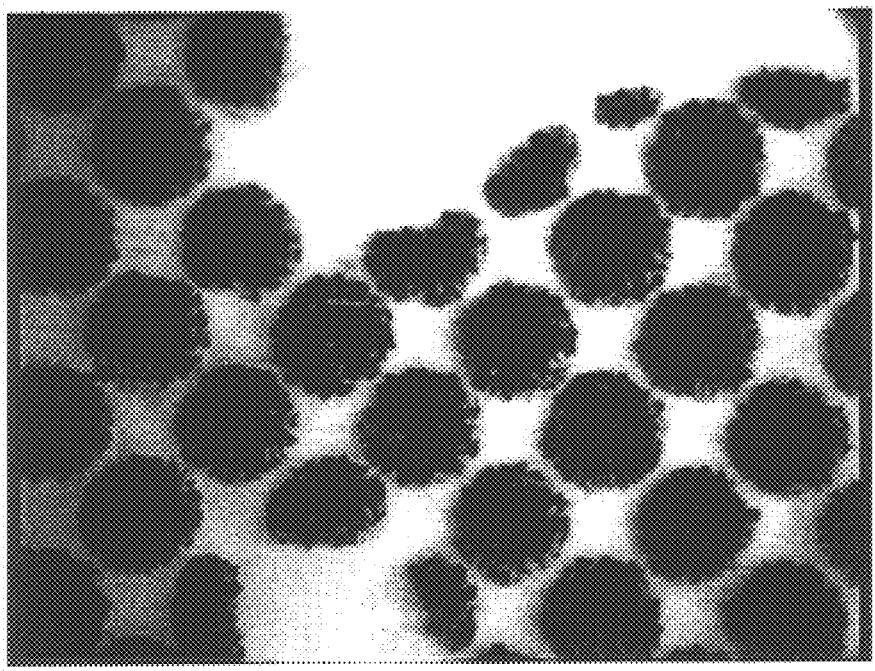
FIG. 3C is a micrograph of the same area of FIG. 2A as printed by a low-resilience surface according to the present invention at 200×magnification.

The print quality improvement achieved can be seen in FIGS. 3A–3C. The three microphotographs shown in the figure were taken at 200×. FIG. 3A shows an area of an offset printing plate of a 50% screen of dots and represents the ultimate ideal print quality that could be achieved if in printing the image the dots could be printed without distortion. It should be noted that the dots in this image are sharp edged. FIG. 3B shows the same area as printed on very smooth, heavily coated paper using a high quality prior art printing blanket. It should be noted that the dots were ragged edged with some filaments of ink touching other dots. FIG. 3C shows the result achieved by printing with a low-resilience printing surface according to the present invention. The dots shown in FIG. 3C are extremely sharp edged in comparison to the previous image achieved via the prior art surface. In fact, on close examination by someone trained in the art of printing it was clear that the primary distortion in the dots was from the slight texture of the paper itself.

Thus, while there have shown and described and pointed out fundamental novel features or the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A method for transferring ink onto a substrate comprising:

providing an offset printing blanket comprising a printing layer and a base, wherein the printing layer has a Shore Resilience of less than about 40% and an average surface roughness of less than about 0.5 microns, said printing layer comprising:

(a) a filler selected from the group consisting of synthetic fibers, glass beads, thermoplastic microspheres, and mixtures thereof; and (b) an elastomer selected from the group consisting of acrylonitrile butadiene rubber, isobutylene isoprene elastomer, polysulfide rubber, ethylene propylenediene terpolymer, natural rubber, neoprenes, nitrile rubbers, styrene butadiene rubber, a blend of acrylonitrile-butadiene and polysulfide rubber, and mixtures thereof;

transferring ink to said offset printing blanket from an image-bearing printing element; and transfering said ink from said offset printing blanket onto a substrate, wherein at least about 75% of said ink is transferred from said offset printing blanket to said substrate.

2. The method of claim 1 wherein at least 90% of said ink is transferred from said offset printing blanket to said substrate.

3. The method of claim 2 wherein the elastomer layer comprises nitrile rubber.

4. The method of claim 3 wherein the nitrile rubber is nitrile butadiene rubber.

5. The method of claim 1 wherein the printing layer has a Shore Resilience of less than about 30%.

6. The method of claim 1 wherein the printing layer has a Shore Resilience of less than about 20%.

7. A method for transferring ink onto a substrate comprising:

providing an offset printing blanket comprising a printing layer and a base, wherein the printing layer has a Shore Resilience of less than about 20% and an average surface roughness of less than about 0.5 microns, said printing layer comprising:

(a) a filler selected from the group consisting of carbon black, synthetic fibers, glass beads, thermoplastic microspheres, and mixtures thereof; and (b) an elastomer selected from the group consisting of acrylonitrile butadiene rubber, isobutylene isoprene elastomer, polysulfide rubber, ethylene propylenediene terpolymer, natural rubber, neoprenes, nitrile rubbers, styrene butadiene rubber, a blend of acrylonitrile-butadiene and polysulfide rubber, and mixtures thereof;

transferring ink to said offset printing blanket from an image-bearing printing element; and transferring said ink from said offset printing blanket onto a substrate, wherein at least about 75% of said ink is transferred from said offset printing blanket to said substrate.

8. The method of claim 7 wherein at least 90% of said ink is transferred from said offset printing blanket to said substrate.

9. The method of claim 8 wherein the elastomer layer comprises nitrile rubber.

10. The method of claim 9 wherein the nitrile rubber is nitrile butadiene rubber.

* * * * *